US005531912A

United States Patent [19]

Church et al.

[11] Patent Number: 5,531,912

[45] Date of Patent: Jul. 2, 1996

[54] COMPOSITION AND PROCESS FOR LUBRICATING METAL BEFORE COLD FORMING

[75] Inventors: Richard J. Church, Madison Heights; Kenneth J. Hacias, Sterling Heights, both of Mich.

[73] Assignee: Henkel Corporation, Plymouth Meeting, Pa.

[21] Appl. No.: 300,665

[22] Filed: Sep. 2, 1994

[51] Int. Cl.[6] ..... C10M 173/00

[52] U.S. Cl. ..... 508/507; 72/42; 508/155; 508/158; 508/269; 508/276; 508/280; 508/282

[58] Field of Search ..... 252/49.3, 49.5, 252/52 A, 56 R; 72/42

[56] References Cited

U.S. PATENT DOCUMENTS

| | | | |
|---|---|---|---|
| 3,873,458 | 3/1975 | Parkinson | 252/495 |
| 4,362,844 | 12/1982 | Lemstra et al. | 525/57 |
| 4,461,712 | 7/1984 | Jonnes | 252/49.5 |
| 4,666,946 | 5/1987 | Fudge | 521/59 |
| 4,692,471 | 9/1987 | Fudge | 521/59 |
| 4,693,909 | 9/1987 | Ziegler et al. | 427/156 |
| 4,731,190 | 3/1988 | O'Lenick, Jr. et al. | 252/49.3 |
| 4,931,197 | 6/1990 | Beck et al. | 252/56 R |
| 5,079,340 | 1/1992 | Auerbach et al. | 528/392 |
| 5,137,956 | 8/1992 | Trivett | 252/56 R |
| 5,198,301 | 3/1993 | Hager | 428/355 |
| 5,368,757 | 11/1994 | King | 252/49.5 |

OTHER PUBLICATIONS

Chem. Ab. vol. 081, No. 20, Sec. 036, Abstract No. 121834 date unavailable.

*Primary Examiner*—Jacqueline V. Howard

*Attorney, Agent, or Firm*—Wayne C. Jaeschke; Norvell E. Wisdom, Jr.; Beatrice N. Robbins

[57] ABSTRACT

A stearate free solid lubricant for cold working of metals contains approximately equal amounts of an alkene-acrylate ionomer and an alkoxylated alcohol in which the alcohol moiety has from 18–60 carbon atoms and the alkoxylate block has about the same number of carbon atoms. This lubricant can be conveniently applied from aqueous solution/suspension and works effectively even when the underlying steel surface has no conversion coating, which is usually required with stearate lubricants for best results.

20 Claims, No Drawings

COMPOSITION AND PROCESS FOR LUBRICATING METAL BEFORE COLD FORMING

BACKGROUND OF THE INVENTION

1. Field of the Invention

This invention relates to compositions and processes that are useful for lubricating the surfaces of metals, especially aluminum, copper, and/or most particularly steel, before and during cold forming operations, particularly cold drawing operations. The metal surfaces may or may not have other surface layers such as phosphate conversion coatings; anodized coatings; complex oxide layers such as those that can be formed with a commercially available product named BONDERITE® 770X from the Parker Amchem Div. of Henkel Corp., Madison Heights, Mich.; or the like underlying the lubricant coating produced on the surface by using this invention. The invention also relates to processes utilizing such compositions.

2. Statement of Related Art

The most widely used lubricants for steel cold forming operations now are believed to be stearate soaps applied over heavy zinc phosphate conversion coating layers. These produce satisfactory drawing results, but are susceptible to dusting, which can become a severe nuisance to workers during the drawing operations. Stearates also often result in the generation of substantial volumes of sludge, which can become an expensive disposal problem. Furthermore, the phosphate conversion coatings usually contain heavy metals such as nickel, manganese, or calcium in addition to zinc in order to achieve the best drawing results, and such metals may cause pollution problems in disposal. It is an object of this invention to provide alternative lubricants with at least equally acceptable performance during the drawing operation and less disposal, or other environmental, problems.

DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes oligomer; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its variations may be applied to elemental, ionic, and any other chemical species defined by number and type of atoms present, as well as to compounds with well defined molecules.

SUMMARY OF THE INVENTION

It has been found that aqueous liquid compositions comprising, preferably consisting essentially of, or more preferably consisting of, water and:

(A) an at least partially neutralized film forming copolymer of an alkene that contains no carboxyl or carboxylate group and a comonomer that is an organic acid including the moiety C=C—COOH, such at least partially neutralized polymers of organic acids often being denoted in the art generally and hereinbelow as "ionomers";

(B) an alkoxylated alcohol film forming component; and, optionally, one or more of:

(C) a boron containing inorganic acid or salt;

(D) an extreme pressure lubricant additive as known per se in the art; and (E) a corrosion, staining, and discoloration inhibitor component deposit on the surface of metal, preferably aluminum, copper, and/or, most preferably, steel, objects contacted therewith films that, after drying, provide satisfactory lubrication for cold forming operations. A polymer is defined as "film forming" for the purposes of this description if, when a solution or suspension of the polymer in water is dried at a temperature of at least 25° C. from a liquid film thickness not greater than 1 millimeter, a continuous and coherent film that is solid at 25° C. is produced.

Embodiments of the invention include liquid compositions for applying to metal surfaces to provide lubrication as described; solid and/or liquid layers on metal surfaces being cold worked, which may be formed, in the case of solid layers, by drying the liquid compositions originally applied; processes for cold working metals using such compositions for lubrication, and concentrates for making suitable compositions for direct application to metal surfaces by diluting the concentrates with water.

Compositions according to the invention provide a very pliable and ductile lubricating film, thereby leading to superior cold forming processes.

DESCRIPTION OF PREFERRED EMBODIMENTS

The alkene polymerized to make component (A) preferably is selected from the group consisting of ethene (more commonly called "ethylene"), propene, 2-methyl propene, and 1- and 2-butenes; more preferably it is ethene or propene, most preferably ethene. For the unsaturated organic acid comonomer to make component (A), acrylic acid is most preferred, and methacrylic acid and other homologs of acrylic acid, i.e., molecules differing from acrylic acid by the addition of one or more —$CH_2$— groups, with not more than six, preferably not more than four, carbon atoms per molecule are next most preferred. The fraction of the mass of the polymer made up of alkene residues preferably is, with increasing preference in the order given, not less than 1, 2, 4, 15, 30, 40, 50, 55, 60, 65, 70, 75, 80, or 84%; independently, the fraction of the mass of the polymer made up of alkene residues preferably is, with increasing preference in the order given, not more than 99, 97, 95, 92, 90, 89, 87, or 86%. Independently, the fraction of the mass of the polymer made up of acrylic acid and/or acrylate residues preferably is, with increasing preference in the order given, not less than 1, 2, 4, 6, 8, 10, 11, 12, 13, or 14%; independently, the fraction of the mass of the polymer made up of acrylic acid and/or acyrlate residues preferably is, with increasing preference in the order given, not more than 50, 40, 35, 30, 25, 20, 18, or 16%.

Normally, commercially available polymers in latex form are preferred for component (A); a variety of such commercial products are available. Such products normally contain small amounts of surfactants for stabilizing the polymers in suspension; these surfactants normally have no adverse effect on compositions according to this invention.

The counterions for the neutralized acrylic acid units in the polymers are preferably selected from the group consisting of magnesium, calcium, zinc, and alkali metal ions, more preferably zinc, magnesium, and calcium. If alkali metal ions are used, the compositions preferably contain optional component (C) as described above.

The oxyalkylene units in component (B) of a composition according to this invention preferably have not more than 4, more preferably not more than 3, most preferably 2, carbon atoms per unit. Component (B) of the compositions according to the invention is preferably selected from molecules having a chemical structure that can be produced by condensing an alkylene oxide with primary, preferably straight chain, aliphatic alcohols having only one hydroxyl group and, with increasing preference in the order given, at least 18, 25, 30, 35, 40, 43, 46 or 48 carbon atoms per molecule and independently, with increasing preference in the order given, not more than 65, 60, 57, 55, 52, or 51 carbon atoms per molecule. Independently, it is preferred that the molecules of component (B) contain, with increasing preference in the order given, at least 20, 30, 35, 40, 43, 47, or 49%, and independently preferably contain, with increasing preference in the order given, not more than 80, 70, 62, 57, 54, or 51% of their total mass in the oxyalkylene units.

The ratio by weight of component (A) to component (B) in compositions according to the invention preferably is, with increasing preference in the order given, at least 1:10, 1:8, 1.0:6.5, 1.0:5.0, 1.0:3.5, 1.0:2.5, 1.0:2.0, 1.0:1.8, 1.0:1.6, 1.0:1.4, 1.0:1.3, 1.0:1.2, 1.0:1.10, or 1.00:1.05 and independently preferably is, with increasing preference in the order given, not more than 10:1, 8:1, 6.5:1.0, 5.0:1.0, 3.5:1.0, 2.5:1.0, 2.0:1.0, 1.8:1.0, 1.6:1.0, 1.4:1.0, 1.3:1.0, 1.2:1.0, 1.10:1.0, or 1.05:1.00. When component (C) is used, the amount of it preferably is, with increasing preference in the order given, not less than 0.5, 1.0, 1.5, 2.0, 2.5, 3.0, or 3.4% and independently preferably is, with increasing preference in the order given, not more than 25, 15, 12, 10, 8.5, 7.5, or 6.8% of the total of components (A), (B), and (C).

Component (D) of the compositions according to the invention is preferably selected from partial esters, or salts of partial esters, of phosphoric acid with alcohols having a molecular structure that contains both (i) a part having the structure $—(CH_2)_m—$, where m is an integer between 12 and 22 inclusive, more preferably between 16 and 22 inclusive and (ii) a part having the structure $—(CH_2—CH_2—O)_p$, where p is an integer having a sufficiently large value that the total alcohol is soluble in water to the extent of, with increasing preference, at least 0.1, 0.4, 0.9, 1.3, 1.8, and 3 percent by weight.

If component (D) is used, it is preferably present in a ratio by weight to the total of components (A) and (B) within the range from 1:10 to 1:200, or more preferably from 1:25 to 1:70, still more preferably from 1:40 to 1:55.

If component (E) as described above is used, it preferably consists of:

(E.1) a primary inhibitor component selected from the group consisting of non-sulfur-containing organic azole compounds, preferably organic triazoles, more preferably benzotriazole or tolyltriazole; and (E.2) a secondary inhibitor component selected from the group consisting of organic azoles that also contain mercapto moieties, preferably mercaptobenzothiazole or mercaptobenzimidazole.

The concentration of component (E.1) in a working aqueous liquid composition according to this invention preferably is, with increasing preference in the order given, not less than 10, 40, 100, 200, 400, 800, 1200, 1400, 1500, 1600, 1700, 1750, 1800, 1850, 1900, 1925, 1950, or 1975 parts per million (hereinafter often abbreviated "ppm") of the total composition and independently preferably is, with increasing preference in the order given, not more than 20,000, 10,000, 5000, 3500, 3300, 3100. 2800, 2500, 2400, 2300, 2250, 2200, 2175, 2150, 2125, 2100, 2075, 2050, or 2025 ppm. Chemically, as already noted above, it is preferred for component (E.1) to be selected from benzotriazole and tolyltriazole, and in fact a mixture of these two is more preferred than either of them alone. The amount of each of benzotriazole and tolyltriazole, expressed as a percentage of the total of component (E.1) preferably is, with increasing preference in the order given, independently for each of these two triazoles, not less than 5, 10, 15, 20, 25, 30, 35, 38, 41, 43, 45, 47, 48, or 49% and independently preferably is, with increasing preference in the order given, not more than 95, 90, 85, 80, 75, 70, 65, 62, 59, 57, 55, 53, 52, or 51%.

The concentration of component (E.2) in a working aqueous liquid composition according to this invention preferably is, with increasing preference in the order given, not less than 1, 4, 10, 15, 20, 25, 30, 35, 38, 41, 43, 45, 47, or 49 ppm of the total composition and independently preferably is, with increasing preference in the order given, not more than 2000, 1000, 500, 350, 300, 250, 200, 175, 165, 155, 145, 135, 125, 120, 115, 110, 107, 110, 108, 106, 105, 104, 103, 102, or 101 ppm of the total composition. The ratio of the concentration of component (E.2) to the concentration of component (E.1) preferably is, with increasing preference in the order given, not less than 0.001:1, 0.002:1, 0.004:1, 0.007:1, 0.011:1.0, 0.015:1.0, 0.019:1.0, 0.020:1.0, 0.021:1.0, 0.022:1.0, 0.023:1.0, or 0.024:1.0 and independently preferably is, with increasing preference in the order given, not more than 2:1, 1:1, 0.5:1, 0.3:1, 0.2:1, 0.1:1, 0.09:1.0, 0.08:1.0, 0.07:1.0, 0.06:1.0, 0.05:1.0, 0.04:1.0, 0.035:1.00, 0.033:1.00, 0.031:1.00, 0.029:1.00, 0.028:1.00, 0.027:1.00, or 0.026:1.00. These ratios, unlike the concentration preferences stated above, apply to concentrates as well as to working compositions.

The pH value of a working composition according to this invention preferably is, with increasing preference in the order given, not less than 5.5, 6.0, 6.5, 7.0, 7.4, 7.7, 8.0, 8.1, 8.2, 8.3, 8.4, 8.5, 8.6, 8.7, 8.8, 8.9, or 9.0 and independently preferably is, with increasing preference in the order given, not more than 12.0, 11.7, 11.5, 11.3, 11.1, 11.0, 10.9. 10.8, 10.7, 10.6, or 10.5.

The total solids content of components (A) and (B) in a working composition according to the invention preferably is, with increasing preference in the order given, not less than 0.1, 0.5, 1, 2, 3, 4, 5, 5.5, 6.0, 6.4, 6.7, 6.9, 7.2, 7.4, or 7.5% and independently preferably is, with increasing preference in the order given, not more than 25, 20, 18, 17, 16, 15.5, or 15.1%.

For various reasons it is often preferred that the compositions according to the invention be free from various materials often used in prior art lubricants. In particular compositions according to this invention usually preferably contain, with increasing preference in the order given, and with independent preference for each component named, not more than 5, 2, 1, 0.5, 0.25, 0.12, 0.06, 0.03, 0.015, 0.007, 0.003, 0.001, 0.0005, 0.0002, or 0.0001% of any of (i)

hydrocarbons, (ii) fatty oils of natural origin or chemically equivalent synthetic oils, (iii) other ester oils and greases that are liquid at 25° C., (iv) metal salts of fatty acids, (v) hexavalent chromium, (vi) nickel cations, (vii) cobalt cations, (viii) copper cations, (ix) manganese in any ionic form, (x) graphite, and (xi) molybdenum sulfide.

The areal density (also often called "add-on weight [or mass]") of a composition according to this invention present in place on the surface of metal to be cold worked preferably is, with increasing preference in the order given, not less than 0.1, 0.5, 1.0, 2.0, 3.0, 4.0, 5.0, 5.8, 6.6, 6.9, 7.0, 7.1, 7.2, or 7.3 grams per square meter of surface (hereinafter often abbreviated "$g/m^2$") and independently preferably is, with increasing preference in the order given, not more than 60, 40, 30, 27, 24, 21, 19.5, 18.5, 18.0, 17.7, 17.4, 17.3, or 17.2 $g/m^2$.

The practice of this invention may be further appreciated by consideration of the following, non-limiting, working examples, and the benefits of the invention may be further appreciated by reference to the comparison examples.

EXAMPLE AND COMPARISON EXAMPLE

Group 1

In this group the substrates coated were "button" drawing test sheet specimens with dimensions of 45.7×5.1×0.15 centimeters (hereinafter often abbreviated "cm"), made of cold rolled steel. The test specimens were subjected to the process steps shown in Table 1.1.

For examples according to the invention in this group, the coating bath contained a total of 15% solids, half of which was provided by a commercial ionomer dispersion/solution sold by Allied Signal Corp. under the name ACqua™, as noted

TABLE 1.1

PROCESS SEQUENCE FOR GROUP 1

| Step No. | Step Name | Treatment Composition | Contact Conditions °C. | Contact Conditions Min |
|---|---|---|---|---|
| 1 | Cleaning | Aqueous Solution of 30 g/L of PARCO ® Cleaner 2077X | 88 | 30 |
| 2 | Rinsing | Water | 54 | 1 |
| 3 | Pickling | Aqueous solution of 10% by volume of $H_2SO_4$ | 71 | 5 |
| 4 | Rinsing | Water | 15 | 1 |
| 5 | Coating | As described elsewhere herein | 71 | 2 |
| 6 | Baking | Air | 82 | 10 |

Notes for Table 1.1

"°C." indicates the temperature in Centigrade degrees of the fluid during contact with the substrate being treated; "Min" indicates the time of contact in minutes. PARCO ® Cleaner 2077X is commercially available from Parker Amchem Div. of Henkel Corp., Madison Heights, Michigan and is a highly alkaline cleaner designed to remove both sodium and calcium soaps commonly used in lubricating metals prior to cold working and also to remove any conversion coatings present on the metal surface.

in more detail below, and half of which was provided by a commercially available ethoxylated high molecular weight alcohol sold by Petrolite Corp., Tulsa, Okla. under the name UNITHOX™ 750, as also identified further below. For the specimens designated as "Control" below, the coating instead was provided by a conventional zinc phosphate coating at a specific areal density of 9.5 $g/m^2$, followed by sodium stearate at a specific areal density of 12.6 $g/m^2$.

After coating and drying, the specimens were drawn between two opposed dies maintained at a temperature of 149° C. with a clamping force of 1814 kilograms-force between them. One of the two opposed dies had a flat carbide steel surface with dimensions of 6.3×4.5 cm. The second die had a raised flat topped square "button" with an edge length of 1.3 cm; this was the only part of the second die that touched the specimen during drawing or clamping. The specimen was drawn between the dies over a length of about 29 cm, and the force required for drawing was measured and recorded automatically on chart paper. The average value of the slightly fluctuating force during drawing is reported in Table 1.2. Lower values for this force are preferred over higher values.

TABLE 1.2

| Ionomer | Cations | $g/m^2$ of Coating | Force, Kg. |
|---|---|---|---|
| ACqua ™ 220 | $Zn^{+2}$ | 7.5 | 44.9 |
| ACqua ™ 240 | $Na^{+}$ | 7.4 | 67.2 |
| ACqua ™ 250 | $Ca^{+2}$ | 9.1 | 47.6 |
| ACqua ™ X-8350 | $Mg^{+2}$ | 7.3 | 48.1 |
| | Control | | 37.2 |

Group 2

In Group 2, the substrates were tubes of ASM Type 1020 steel alloy, which were eventually drawn so that the cross-sectional area was reduced by 35%. Pre-drawing process conditions are shown in Table 2.1. Performance was rated by the fraction of tubes successfully drawn under these conditions. The coating compositions according to the invention that were used in this Group are shown in Table 2.2. They contained the same ionomers as are shown for the same cations in Table 1.2 and also contained UNITHOX™ 750 in an amount equal (as solids) to that of the ionomer. In this Group, the total solids concentration in the coating composition was varied, as shown in Table 2.2. Also, in some cases, boric acid at a concentration of 6.7 of the total nonvolatile content of the composition and sodium borate decahydrate at a concentration of 3.5% of the total nonvolatile content of the composition were added and are indicated by use of the phrase "boron added" in Table 2.2.

Group 3

In this group, steel tubes with a diameter of 2.5 cm and a length of 3.66 meters were used as the substrates. The process sequence used is shown in Table 3.1. Various types of steel were used, as shown in Table 3.2. The coating solution

TABLE 2.1

PROCESS SEQUENCE FOR GROUP 2

| Step No. | Step Name | Treatment Composition | Contact Conditions °C. | Contact Conditions Min |
|---|---|---|---|---|
| 1 | Cleaning | Aqueous Solution of 30 g/L of PARCO ® Cleaner 2077X | 88 | 30 |
| 2 | Rinsing | Water | 54 | 1 |
| 3 | Pickling | Aqueous solution of 10% by volume of $H_2SO_4$ + 0.25% by volume of the volume of $H_2SO_4$ of RODINE ® 95 | 71 | 30 |
| 4 | Rinsing | Water | 15 | 1 |
| 5 | Coating | As described elsewhere herein | 71 | 2 |
| 6 | Baking | Air | 82 | 45 |

Notes for Table 2.1

RODINE ® 95 is a highly soluble, semi-foaming, liquid inhibitor containing an appreciable amount of detergent; it is commercially available from Parker Amchem Div. of Henkel Corp., Madison Heights, Michigan. Other notes are the same as for Table 1.1.

TABLE 2.2

| % Solids in Coating Composition | Cation in Ionomer Used | Boron Present? | Dry Add-On Mass of Coating, $g/m^2$ | Number of Tubes Successfully Drawn/Out of Number Attempted |
|---|---|---|---|---|
| 15 | Zn | No | 9.7–10.8 | 6/6 |
| 15 | Zn | Yes | 9.7–10.8 | 4/4 |
| 15 | Na | No | 16.1–17.2 | 1/3 |
| 15 | Na | Yes | 16.1–17.2 | 4/5 |
| 7.5 | Ca | Yes | 5.4–6.5 | 5/5 |

TABLE 3.1

PROCESS SEQUENCE FOR GROUP 3

| Step No. | Step Name | Treatment Composition | Contact Conditions °C. | Contact Conditions Min |
|---|---|---|---|---|
| 1 | Cleaning | Aqueous Solution of 30 g/L of PARCO ® Cleaner 2077X | 88 | 30 |
| 2 | Rinsing | Water | 54 | 1 |
| 3 | Pickling | Aqueous solution of 10% by volume of $H_2SO_4$ + 0.25% by volume of the volume of $H_2SO_4$ of RODINE ® 95 | 71 | 15 |
| 4 | Rinsing | Water | 15 | 1 |
| 5 | Coating | As described elsewhere herein | 71 | 2 |
| 6 | Baking | Air | 82 | 45 |

Notes for Table 3.1
Notes for this table are the same as for Table 2.1.

TABLE 3.2

| Tube Steel Type | Inhibitor(s) | Rating |
|---|---|---|
| ASM 1018 | Thiazole | 1 |
| ASM 1018 | Combination | 0 |
| ASM 4130 | Thiazole | 1–2 |
| ASM 4130 | Combination | 0 |
| ASM 1026 | Thiazole | 1–2 |
| ASM 1026 | Combination | 0 |
| ASM 1010 | Combination | 0 |

contained ACqua™ 220 as its ionomer and the same ethoxylated alcohol component as for the examples according to the invention in the preceding groups, with a total solids content from components (A) and (B) of 15%. The coating solutions also contained inhibitor components, which are indicated in Table 3.2 as follows: "Thiazole" means that the only inhibitor component was 50 ppm of 2-mercaptobenzothiazole and "combination" means that 50 ppm of 2-mercaptobenzothiazole and 1000 ppm of each of tolyltriazole and benzotriazole were included in the coating composition.

After processing in the process sequence shown in Table 3.1, the tubes were cross-sectioned so that the interior of the tubes could be examined for evidence of corrosion, staining, and/or discoloration. Ratings from this examination, as shown in Table 3, were reported on the following scale:

0: No visible discoloration or corrosion

1: Light yellow to light brown discoloration

2: Dark brown discoloration

3: Very dark discoloration and corrosion.

The invention claimed is:

1. An aqueous liquid composition of matter consisting essentially of water and:

(A) an at least partially neutralized film forming copolymer ("ionomer") of an alkene that contains no carboxyl or carboxylate groups and comonomer that is an organic acid that contains the moiety C=C—COOH; and (B) an alkoxylated alcohol film forming component.

2. An aqueous liquid composition of matter according to claim 1, wherein the ratio by weight of component (A) to component (B) is within the range from about 1.0:2.5 to about 2.5:1.0 and the composition optionally includes one or more of the following components:

(C) a boron containing inorganic acid or salt;

(D) an extreme pressure lubricant additive and (E) a corrosion, staining, and discoloration inhibitor component.

3. An aqueous liquid composition of matter according to claim 2, wherein: the alkene polymerized to make ionomer component (A) is selected from the group consisting of ethene, propene, 2-methylpropene, and 1- and 2-butenes; the comonomer polymerized to make ionomer component (A) in its unneutralized form is selected from the group consisting of acrylic acid and homologs of acrylic acids that contain no more than six carbon atoms per molecule; the fraction of the mass of ionomer component (A) in its unneutralized form that is made up of alkene residues is within the range from about 60 to about 90% and the fraction of ionomer component (A) in its unneutralized form that is made up of the total of acrylic acid and its homologs is within the range from about 10 to about 40%; the oxyalkylene units of component (B) have no more than 4 carbon atoms per unit; the molecules of component (B) contain from about 20 to about 80% of their total mass in the oxyalkylene units; the counterions for component (A) are selected from the group consisting of magnesium, calcium, zinc, and alkali metal ions; and, if the counterions are alkali metal ions, the composition also contains component (C) in an amount that is from about 1.0 to about 15% of the total of components (A) and (B).

4. An aqueous liquid composition of matter according to claim 3, wherein: the alkene polymerized to make ionomer component (A) is selected from the group consisting of ethene and propene; the comonomer polymerized to make ionomer component (A) in its unneutralized form is selected from acrylic and methacrylic acids; the fraction of the mass of ionomer component (A) in its unneutralized form that is made up of alkene residues is within the range from about 65 to about 89% and the fraction of ionomer component (A) in its unneutralized form that is made up of the total of acrylic acid and its homologs is within the range from about 11 to about 35%; the oxyalkylene units of component (B) have not more than 3 carbon atoms per unit; the molecules of component (B) contain from about 18 to about 70% of their total mass in the oxyalkylene units; and if the counterions for component (A) are alkali metal ions, the composition also contains component (C) in an amount that is from about 1.5 to about 12% of the total of components (A) and (B).

5. An aqueous liquid composition of matter according to claim 4, wherein: the alkene polymerized to make ionomer component (A) is ethene; the fraction of the mass of ionomer component (A) in its unneutralized form that is made up of ethylene residues is within the range from about 70 to about 87% and the fraction of ionomer component (A) in its unneutralized form that is made up of the total of acrylic acid and homologs thereof is within the range from about 12 to about 30%; the oxyalkylene units of component (B) are oxyethylene; the molecules of component (B) contain from about 35 to about 62% of their total mass in the oxyalkylene units; and if the counterions for component (A) are alkali metal ions, the composition also contains an amount of component (C) that is from about 1.5 to about 12% of the total of components (A) and (B).

6. An aqueous liquid composition of matter according to claim 5, wherein: the fraction of the mass of ionomer component (A) in its unneutralized form that is made up of ethylene residues is within the range from about 75 to about 87% and the fraction of ionomer component (A) in its unneutralized form that is made up of the total of acrylic acid and homologs thereof is within the range from about 12 to about 20%; the molecules of component (B) are selected from molecules having a chemical structure that can be produced by condensing ethylene oxide with primary aliphatic alcohols having only one hydroxyl group and from 30 to 65 carbon atoms per molecule; the molecules of component (B) contain from about 35 to about 62% of their total mass in the oxyethylene units; if the counterions for component (A) are alkali metal ions, the composition also contains an amount of component (C) that is from about 1.5 to about 12% of the total of components (A) and (B); and the composition contains an amount of component (D) such that the ratio of component (D) to the total of components (A) and (B) is within the range from about 1:10 to about 1:200.

7. An aqueous liquid composition of matter according to claim 6, wherein: the comonomer polymerized to make ionomer component (A) in its unneutralized form is acrylic acid; the fraction of the mass of ionomer component (A) in its unneutralized form that is made up of ethylene residues is within the range from about 80 to about 87% and the fraction of ionomer component (A) in its unneutralized form that is made up of acrylic acid is within the range from about 13 to about 18%; the molecules of component (B) are selected from molecules having a chemical structure that can be produced by condensing ethylene oxide with primary straight chain aliphatic alcohols having only one hydroxyl group and from 40 to 60 carbon atoms per molecule; the molecules of component (B) contain from about 40 to about 57% of their total mass in the oxyethylene units; the counterions for component (A) are selected from the group consisting of calcium, zinc, and magnesium; the composition contains an amount of component (D) such that the ratio of component (D) to the total of components (A) and (B) is within the range from about 1:25 to about 1:70; and component (D) is preferably selected from the group consisting of partial esters, and salts of partial esters, of phosphoric acid with alcohols having a molecular structure that contains both (i) a part having the structure $—(CH_2)_m—$, where m is an integer between 12 and 22 inclusive and (ii) a part having the structure $—(CH_2—CH_2—O)_p$, where p is an integer having a sufficiently large value that the total alcohol is soluble in water to the extent of at least about 0.9 percent by weight.

8. A composition according to claim 7, wherein: the total concentration of components (A) and (B) from about 7.2 to about 16%; the pH is within the range from about 8.5 to about 10.5; and there are present in the composition from about 950 to about 1050 ppm of each of benzotriazole and tolyltriazole and a total of from about 41 to about 110 ppm of a component (E.2) selected from the group consisting of mercaptobenzothiazole and mercaptobenzimidazole.

9. A composition according to claim 6, wherein: the total concentration of components (A) and (B) from about 6.7 to about 18%; the pH is within the range from about 8.0 to about 10.7; and there is present in the composition an inhibitor component (E) that consists of:

(E.1) from about 1750 to about 2200 ppm of a primary inhibitor component selected from the group consisting of benzotriazole and tolyltriazole; and (E.2) from about 35 to about 125 ppm of a secondary inhibitor component selected from the group consisting of mercaptobenzothiazole or mercaptobenzimidazole.

10. A composition according to claim 5, wherein: the total concentration of components (A) and (B) from about 6.0 to about 18%; the pH is within the range from about 7.7 to about 11.0; and there is present in the composition an inhibitor component (E) that consists of:

(E.1) from about 1500 to about 2500 ppm of a primary inhibitor component selected from the group consisting of non-sulfur-containing organic triazoles; and (E.2) from about 30 to about 120 ppm of a secondary inhibitor component selected from the group consisting of organic azoles that also contain mercapto moieties.

11. A composition according to claim 4, wherein: the total concentration of components (A) and (B) from about 5 to about 20%; the pH is within the range from about 7.4 to about 11.3; and there is present in the composition an inhibitor component (E) that consists of:

(E.1) from about 800 to about 3500 ppm of a primary inhibitor component selected from the group consisting of non-sulfur-containing organic azole compounds; and (E.2) from about 30 to about 155 ppm of a secondary inhibitor component selected from the group consisting of organic azoles that also contain mercapto moieties.

12. A composition according to claim 3, wherein: the total concentration of components (A) and (B) from about 5 to about 20% and the pH is within the range from about 7.4 to about 11.3.

13. A composition according to claim 2, wherein: the total concentration of components (A) and (B) from about 4 to about 25% and the pH is within the range from about 7.4 to about 11.3.

14. A composition according to claim 1, wherein: the total concentration of components (A) and (B) from about 2 to about 25% and the pH is within the range from about 5.5 to about 12.0.

15. A process for cold working a metal object, comprising steps of applying to the surfaces of the metal object to be cold worked a liquid coating of a composition according to claim 14 and drying the liquid coating thus applied onto the coated metal surface before cold working of the metal object.

16. A process for cold working a metal object, comprising steps of applying to the surfaces of the metal object to be cold worked a liquid coating of a composition according to claim 13 and drying the liquid coating thus applied onto the coated metal surface before cold working of the metal object.

17. A process for cold working a metal object, comprising steps of applying to the surfaces of the metal object to be cold worked a liquid coating of a composition according to claim 12 in an amount such that the specific areal density of the coating after drying will be in the range from about 1 to about 60 $g/m^2$ and drying the liquid coating thus applied onto the coated metal surface before cold working of the metal object.

18. A process for cold working a metal object, comprising steps of applying to the surfaces of the metal object to be cold worked a liquid coating of a composition according to claim 11 in an amount such that the specific areal density of the coating after drying will be in the range from about 5 to about 30 $g/m^2$ and drying the liquid coating thus applied onto the coated metal surface before cold working of the metal object.

19. A process for cold working a metal object, comprising steps of applying to the surfaces of the metal object to be cold worked a liquid coating of a composition according to claim 10 in an amount such that the specific areal density of the coating after drying will be in the range from about 5 to about 30 $g/m^2$ and drying the liquid coating thus applied onto the coated metal surface before cold working of the metal object.

20. A process for cold working a metal object, comprising steps of applying to the surfaces of the metal object to be cold worked a liquid coating of a composition according to claim 8 in an amount such that the specific areal density of the coating after drying will be in the range from about 7.0 to about 18 $g/m^2$ and drying the liquid coating thus applied onto the coated metal surface before cold working of the metal object.

* * * * *